US010183262B2

(12) United States Patent
Lambinet et al.

(10) Patent No.: US 10,183,262 B2
(45) Date of Patent: Jan. 22, 2019

(54) STATIC MIXER FOR HOMOGENIZING A MIXTURE OF AT LEAST TWO LIQUIDS AND DOSING DEVICE PROVIDED WITH SUCH A MIXER

(71) Applicant: DOSATRON INTERNATIONAL, Tresses (FR)

(72) Inventors: Sandrine Lambinet, Sadirac (FR); Philippe Duquennoy, Camarsac (FR); Manal Badii, Merignac (FR)

(73) Assignee: DOSATRON INTERNATIONAL, Tresses (FR)

( * ) Notice: Subject to any disclaimer, the term of this patent is extended or adjusted under 35 U.S.C. 154(b) by 112 days.

(21) Appl. No.: 15/109,880

(22) PCT Filed: Jan. 6, 2015

(86) PCT No.: PCT/IB2015/050094
§ 371 (c)(1),
(2) Date: Jul. 6, 2016

(87) PCT Pub. No.: WO2015/104654
PCT Pub. Date: Jul. 16, 2015

(65) Prior Publication Data

US 2016/0325244 A1 Nov. 10, 2016

(30) Foreign Application Priority Data

Jan. 10, 2014 (FR) ..... 14 50195

(51) Int. Cl.
*F04B 13/02* (2006.01)
*B01F 15/04* (2006.01)
(Continued)

(52) U.S. Cl.
CPC ..... *B01F 3/0865* (2013.01); *B01F 3/0861* (2013.01); *B01F 5/0495* (2013.01);
(Continued)

(58) Field of Classification Search
CPC .. B01F 3/0865; B01F 5/0495; B01F 15/0416; B01F 5/0603; B01F 5/0498;
(Continued)

(56) References Cited

U.S. PATENT DOCUMENTS 571,350 A * 11/1896 Fayette ..... B01F 5/0496 137/205.5
1,010,052 A * 11/1911 Hooper ..... F16K 37/00 137/551
(Continued)

FOREIGN PATENT DOCUMENTS

FR 2 967 218 A1 5/2012

OTHER PUBLICATIONS

International Search Report, dated Apr. 15, 2015, from corresponding PCT application.

*Primary Examiner* — Charles Cooley
(74) *Attorney, Agent, or Firm* — Young & Thompson

(57) ABSTRACT

A static mixer (M) for homogenizing a mixture of at least two liquids, especially after injection of an auxiliary liquid (L1) into a main liquid (L), includes: a closed container (1), with an inflow conduit (3) extending from a first wall of the container, up to the vicinity of the opposite wall, and an outflow conduit (4) which is substantially parallel to the inflow conduit, each conduit being provided with a device (3*a*, 4*a*) for connecting to the outside, through the wall of the container.

16 Claims, 5 Drawing Sheets

(51) Int. Cl.

| | |
|---|---|
| ***B01F 5/06*** | (2006.01) |
| ***B01F 5/04*** | (2006.01) |
| ***B01F 5/00*** | (2006.01) |
| ***B01F 3/08*** | (2006.01) |

(52) U.S. Cl.
CPC ..... *B01F 5/0498* (2013.01); *B01F 5/0603* (2013.01); *B01F 15/0416* (2013.01); *F04B 13/02* (2013.01); *B01F 2005/004* (2013.01); *B01F 2005/0022* (2013.01)

(58) Field of Classification Search
CPC ..... B01F 3/0861; B01F 2005/004; B01F 2005/0022; B01F 5/0609; F04B 13/02
USPC ..... 366/167.1
See application file for complete search history.

(56) References Cited

U.S. PATENT DOCUMENTS

| | | | | | |
|---|---|---|---|---|---|
| 1,855,323 | A * | 4/1932 | Sirch | C02F 1/763 | 137/205.5 |
| 2,516,884 | A * | 8/1950 | Kyame | D06B 23/20 | 118/602 |
| 2,681,149 | A * | 6/1954 | Shuldener | B01F 5/0495 | 137/115.02 |
| 4,386,634 | A * | 6/1983 | Stasz | A61M 1/1656 | 141/10 |
| 9,303,634 | B2 | 4/2016 | Furet et al. | | |
| 10,058,828 | B2 * | 8/2018 | Jiskoot | B01F 5/0275 | |
| 2015/0361994 | A1 * | 12/2015 | Furet | B01F 5/0428 | 417/192 |
| 2016/0325244 | A1 * | 11/2016 | Lambinet | B01F 5/0495 | |

* cited by examiner

STATIC MIXER FOR HOMOGENIZING A MIXTURE OF AT LEAST TWO LIQUIDS AND DOSING DEVICE PROVIDED WITH SUCH A MIXER

The invention relates to a static mixer for homogenizing a mixture of at least two liquids, in particular after injection of an auxiliary liquid into a main liquid.

BACKGROUND OF THE INVENTION

Injection by means of hydraulic dosing pumps of a mixture of water and an auxiliary liquid product in two separate phases is known, in particular from FR 2 967 218 in the name of the applicant company. The auxiliary liquid, in the case of use in an agricultural environment, can be constituted by nutrients in solution, or by veterinary drugs. It is important for the mixing of the main liquid and the auxiliary liquid to be as homogenous as possible. The same requirement may apply in other applications, since the dosing pumps in question can be used in industry, in hospitals, or in other fields which also make it necessary to obtain a homogenous liquid mixture, according to the dose prescribed for the auxiliary liquid.

SUMMARY OF THE INVENTION

The objective of the invention is thus to provide a static mixer which is simple and economical to produce, and makes it possible to obtain good homogenization of the liquids mixed.

According to the invention, a static mixer for homogenizing a mixture of at least two liquids, in particular after injection of an auxiliary liquid into a main liquid, is characterized in that it comprises:

- a container closed by walls comprising a top, a bottom and lateral walls;
- an input duct, starting from a first wall of the container, and extending as far as the vicinity of the opposite wall; and
- an output duct, substantially parallel to the input duct, which starts in the vicinity of the first wall and extends as far as the opposite wall, each duct being provided with a device for connection to the exterior through a wall of the container.

The first wall can be formed by the top of the container, and the opposite wall formed by the bottom, the input duct being vertical when the mixer is in the position of work, starting from the top and extending as far as the vicinity of the bottom, whereas the output duct starts in the vicinity of the top and extends as far as the bottom.

According to a variant, the input duct is horizontal, as is the output duct.

Advantageously, the input duct is arranged in the vicinity of the lateral wall of the container, and in particular against the wall.

The output duct can be arranged in the vicinity of the input duct, in particular against the input duct, or it can be offset from it.

The mixer according to the invention induces an eddying flow of the mixture in order to go from the input duct to the output duct, which gives rise to an effect of high homogenization.

In the lower part, the input duct can have a partially open transverse cross-section, the open part of this cross-section being closed substantially by the wall of the container.

The container can have an oval horizontal cross-section, which in particular is elliptical, and the input duct is situated in the vicinity of an end of the large axis of the cross-section, whereas the output duct is situated substantially against the input duct, on the side of the center of the cross-section. The horizontal cross-section of the container can also be circular. Advantageously, the plane of the parallel axes of the input duct and of the output duct contains the large axis of the horizontal cross-section of the mixer.

The top and the bottom of the container can be curved in order to assist the flow of the fluid in the mixer, and ensure good resistance to the pressure.

Preferably, the container is relatively flat, and has a thickness, according to a direction orthogonal to the plane of the axes of the input duct and of the output duct, the ratio of which to the width of the container is between 0.3 and 0.7.

In the case when the container has an oval cross-section, and in particular elliptical, the thickness of the container corresponds to the small axis of the cross-section, whereas the width corresponds to the large axis.

The mixer can be associated with a single pump. According to a variant, the mixer can be produced with two identical half-parts, which are turned and assembled head-to-tail.

The invention also relates to a dosing device for introduction of an auxiliary liquid into a flow of main liquid circulating in a duct, comprising a dosing pump with a differential piston with reciprocal motion in order to collect the auxiliary liquid from a container, this pump comprising a first input for receipt of a flow of main liquid which ensures that the pump is driven, a second input for collection of the auxiliary liquid, and an output for mixing of the auxiliary liquid and the main liquid, this dosing device being characterized in that it comprises a mixer as previously defined arranged at the output of the pump.

The dosing device can comprise a flow divider installed inside the main liquid duct, with the dosing pump being connected in parallel to the flow divider, the first input of the pump being connected by a first pipe to the input of the flow divider, whereas the output of the pump is connected by a second pipe to a neck of the flow divider, the mixer being arranged on the second pipe between the output of the pump and the connection to the neck of the flow divider.

The dosing device can comprise a means for variable throttling of the neck of the flow divider.

The volume of the container is adapted to the dosing pump with which this mixer is used. The volume of the container is advantageously three times the capacity of the dosing pump, or more.

BRIEF DESCRIPTION OF THE DRAWINGS

Apart from the above-described arrangements, the invention consists of a certain number of other arrangements which will be described explicitly hereinafter with reference to an embodiment described in relation to the appended drawings, but which is in no way limiting. In these drawings.

DETAILED DESCRIPTION OF THE PREFERRED EMBODIMENTS

Figure 1:
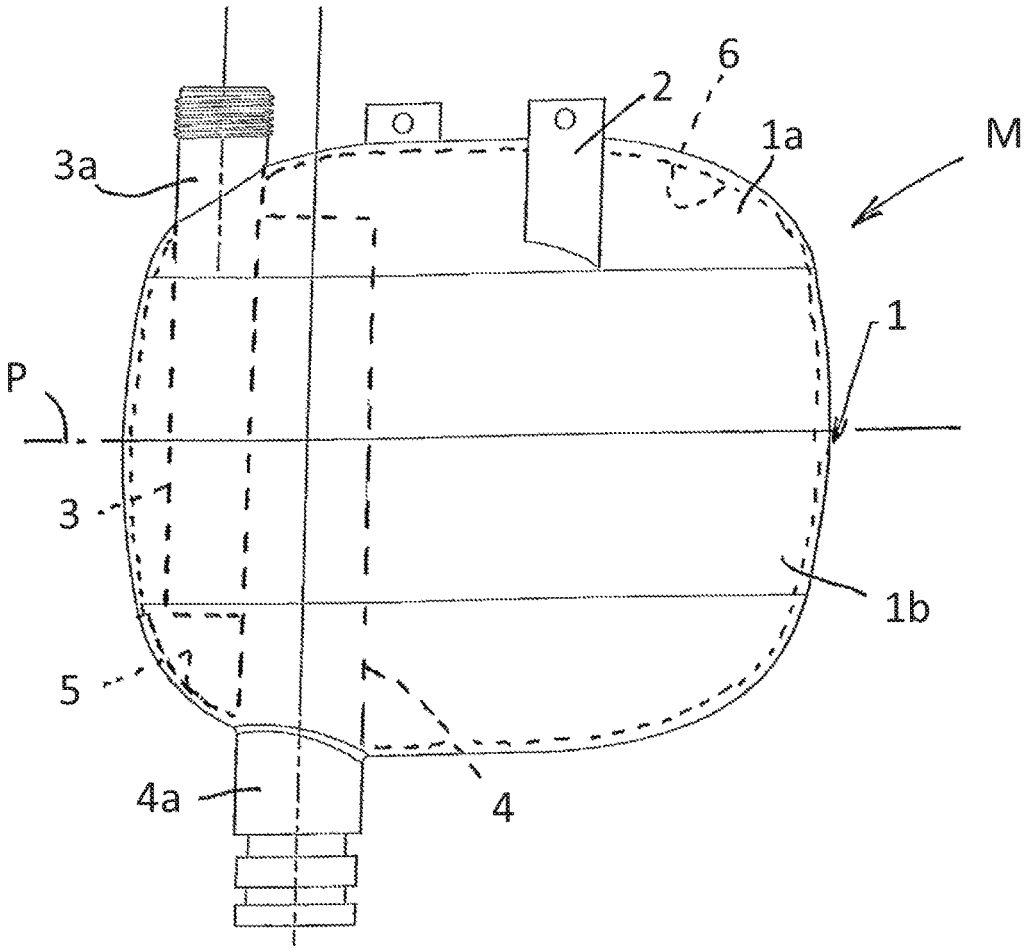
FIG. 1 is an elevated view of a mixer according to the invention.

With reference to the drawings, and in particular FIG. 1, a static mixer M can be seen for homogenizing a mixture of at least two liquids. The mixer M comprises a closed container 1 with a top 1*a*, a bottom 1*b* and lateral walls.

The top 1*a* and the bottom 1*b*, with the associated lateral walls, are in the form of a shell, as can be seen in FIGS. 3-8, with their concavity facing towards one another, and are assembled according to an equatorial plane P, preferably by welding or by screwing. The container 1 is advantageously made of plastic material. The top 1*a* comprises two vertical lugs 2 provided with a hole for optional securing of the container on a support.

Figure 2:
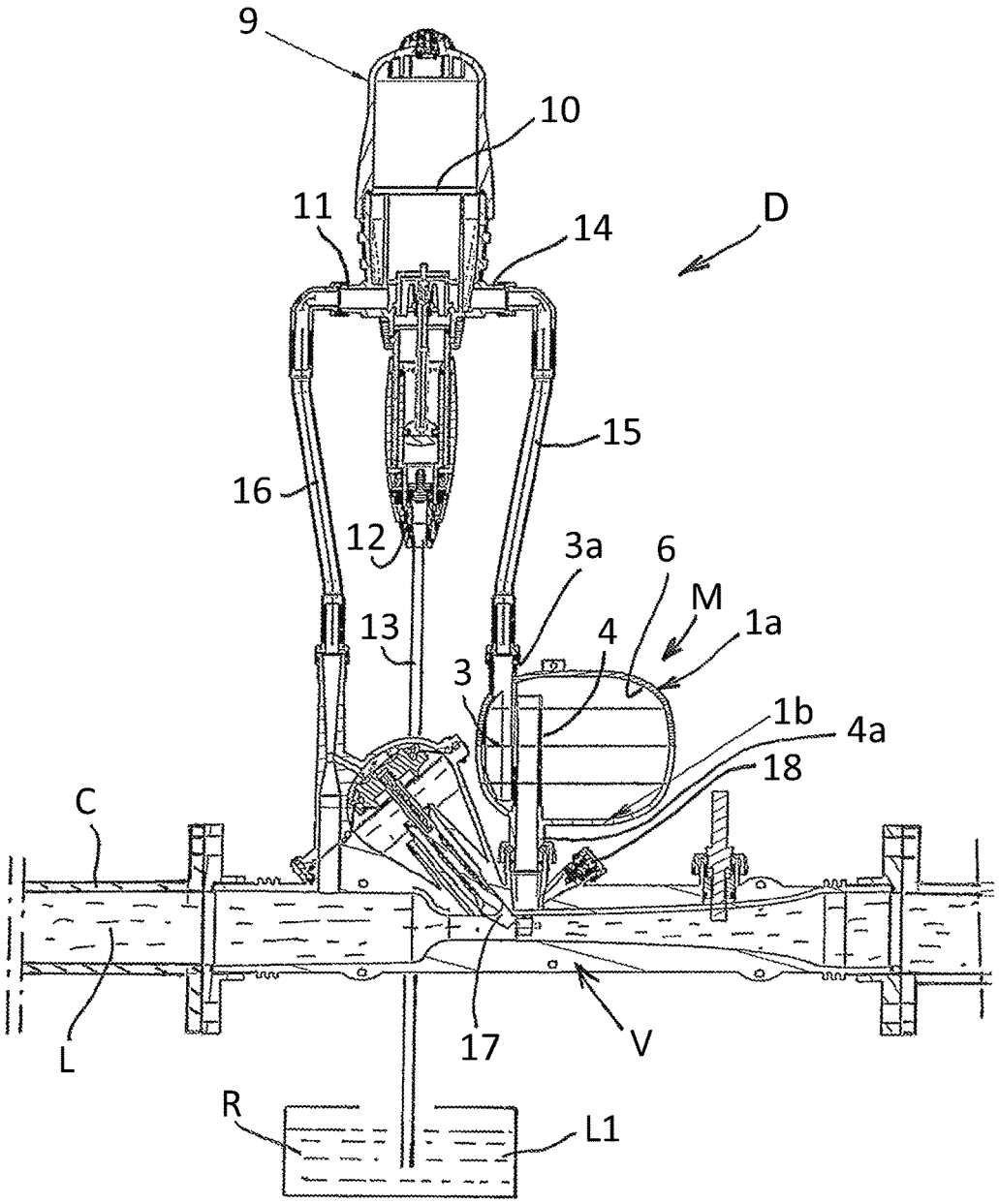
FIG. 2 is a vertical cross-section on a smaller scale of a dosing device with a dosing pump and mixer according to the invention.

The mixer M comprises an input duct 3 which is vertical when the mixer M is in the position of work. The duct 3 starts from the top 1*a* and extends as far as the vicinity of the bottom of the container, as can be seen in FIG. 2. The mean distance between the open lower end of the duct 3 and the bottom 1*b* wall is preferably less than 20 mm. The duct 3 passes through the top 1*a* in order to form threaded connection piping 3*a*.

The mixer M additionally comprises an output duct 4 which is substantially parallel to the input duct 3, starting below and in the vicinity of the top 1*a*, and extending as far as the bottom 1*b*. The mean distance between the open upper end of the duct 3 and the top wall 1*a* is preferably less than 20 mm. The duct 4 is open at the bottom, and passes through the bottom 1*b* in order to form output piping 4*a* which is advantageously provided with annular grooves in order to receive a rapid connection device. The annular grooves permit respectively putting into place a seal and a clip in order to retain a rotary nut which ensures the securing on a threaded joining piece.

As a variant, the input and output ducts could be horizontal between a first lateral wall and an opposite wall.

The top 1*a* and the bottom 1*b* are curved, such that the flow of liquid which emerges from the duct 3 in the low part meets a curved surface 5 of the bottom 1*b* (FIG. 6) which directs the flow towards the opposite area of the container. The concave surface 6 (FIG. 2) of the top 1*a*, distant from the input duct 3, orients the flow towards the output duct 4.

Figure 3:
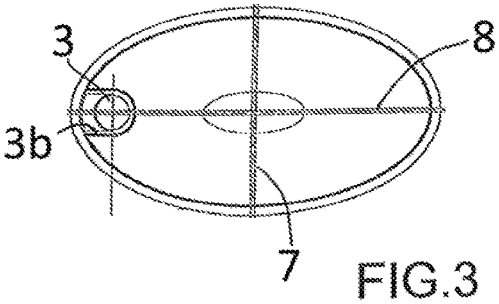
FIG. 3 is a view from below in relation to FIG. 4.
Figure 7:
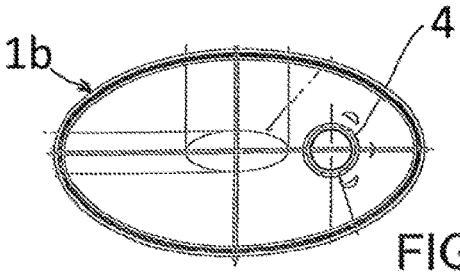
FIG. 7 is a plan view relative to FIG. 6.

The container 1 preferably has an oval horizontal cross-section, in particular elliptical as can be seen in FIGS. 3 and 7, with a small axis 7 and a large axis 8. However, the horizontal cross-section can be circular.

Figure 5:
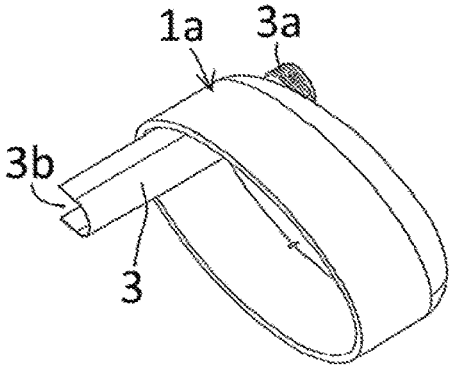
FIG. 5 is a view in perspective from above laid on one side.
Figure 4:
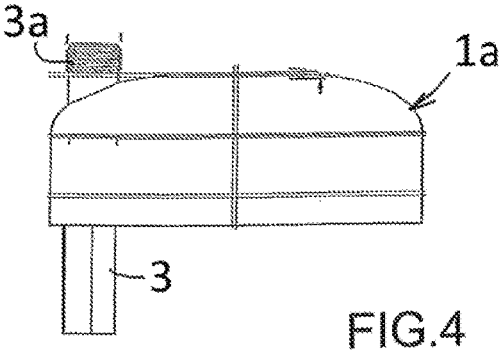
FIG. 4 is an elevated view from above of the mixer.
Figure 6:
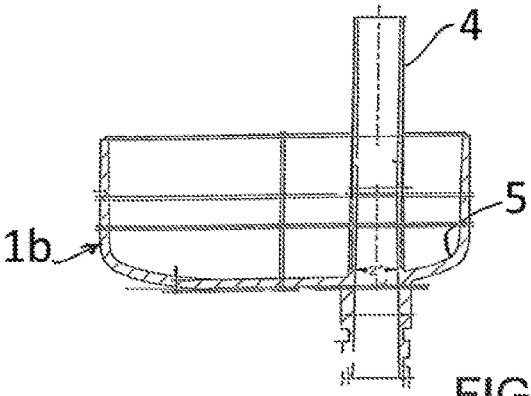
FIG. 6 is a vertical cross-section from below of the mixer, turned by 180° relative to the view from above in FIGS. 3 and 4.
Figure 8:
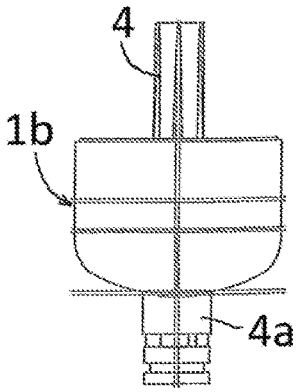
FIG. 8 is a view from the left relative to FIG. 6.

The input duct 3 is situated in the vicinity of the wall of the container, and preferably at an end of the large axis 8 of the cross-section as can be seen in FIGS. 3-5. The lower part 3*b* (FIGS. 3 and 5) can have a transverse cross-section in the form of a "U" which is open towards the wall of the container, and can be supported against an area which forms a belt, of the bottom 1*b*. As a variant, the lower part of the input duct can have the form of a cylindrical pipe.

The output duct 4 is situated substantially against the input duct 3. The geometric axes of the ducts 3 and 4 are situated on a vertical plane which contains the large axis 8 of the horizontal cross-section of the container. As a variant, the output duct can be offset from, i.e. spaced from, the input duct.

The container 1 is relatively flat, i.e. its thickness in a direction orthogonal to the plane of the geometric axes of the ducts 3 and 4 is relatively small in comparison with its width. The thickness of the container 1 corresponds substantially to the dimension of the small axis 7 of the cross-section, whereas the width corresponds substantially to the dimension of the large axis 8. The ratio of the thickness of the container to its width is advantageously between 0.3 and 0.7.

The volume of the container 1 is preferably equal to at least three times the capacity of a dosing pump with a piston with reciprocal motion for which the mixer M would be designed. A volume of 1.5 L for the mixer M is an example of a possible value, for a 3 $m^3$/hour pump with a capacity of 0.5 L.

The top 1*a* and the bottom 1*b* are molded separately, then are assembled by arranging the upper half 1*a* on the lower half 1*b*, such that the input duct 3 is between the output duct 4 and the adjacent wall of the bottom 1*b*. The assembly according to the equatorial plane P is ensured by any appropriate connection means, in particular by welding or by adhesion.

The mixer M is then installed in a position such that the geometric axes of the ducts 3 and 4 are vertical, the input piping 3*a* being in the high part whereas the output piping 4*a* is in the low part. The input piping 3*a* is connected to an intake duct in which a mixture of at least two liquids circulates, and must be made more homogenous. The flow of liquid opens into the low part of the duct 3 at a reduced distance, generally of less than 20 mm, from the bottom wall. When the flow of liquid meets the concave surface 5 of the bottom wall, it describes a short trajectory in the direction of the opposite end of the container 1, and rises again, producing eddies, towards the upper end of the output duct 4, in order to flow out via this duct. The upper end of the duct 4 is situated at a short distance from the upper wall of the top 1*a*, this distance being in particular less than 20 mm.

The eddies created in the mixture 1 for the passage of the flow of liquid from the lower end of the duct 3 to the upper end of the duct 4, in a sufficient volume, makes it possible to homogenize the mixture.

FIG. 2 illustrates a dosing device D for introduction of an auxiliary liquid L1 into a flow of main liquid L circulating in a duct C. The auxiliary liquid L1 is contained in a tank R from which it is taken by a dosing pump 9 with a differential piston 10 with reciprocating straight motion. A dosing pump of this type is known, in particular from EP0255791.

The pump 9 comprises a first input 11 in order to receive a flow of main liquid which ensures that the pump is driven, a second input 12 in order to collect the auxiliary liquid L1 by means of a pipe 13 which is immersed in the tank R, and an output 14 for the mixing of auxiliary liquid and main liquid.

The mixer M is arranged such that its ducts 3, 4 are vertical, and the input connection piping 3*a* is connected to the output 14 of the pump 9 by a pipe 15, in particular a flexible pipe. The output piping 4*a* of the mixer is connected to the duct C.

In the particular example illustrated in FIG. 2, a flow divider V, comprising a Venturi, is inserted in the duct C, and the pump 9 is connected in parallel with the flow divider. The first input 11 of the pump is connected by first piping 16 to the input of the flow divider, whereas the output 14 of the pump is connected by the pipe 15 to the mixer M, the output 4*a* of which is connected to the neck of the flow divider, constituting part of the pipe C.

According to the arrangement in FIG. 2, only a fraction of the main current flow passes through the pump 9. The dosing device D in FIG. 2 can also comprise a means 17 for variable throttling of the neck of the flow divider.

A flap valve 18 which can break a possible vacuum is advantageously provided at the orifice for connection of the flow divider V to the output piping 4*a* of the mixer.

The diameter of the input piping 3*a* is at least equivalent to the diameter of the output 14 of the pump.

The volume of the container of the mixer M is at least equal to three times the capacity of the pump 9. The capacity corresponds to the volume which is displaced during an outward and return course of the differential piston 10.

Figure 9:
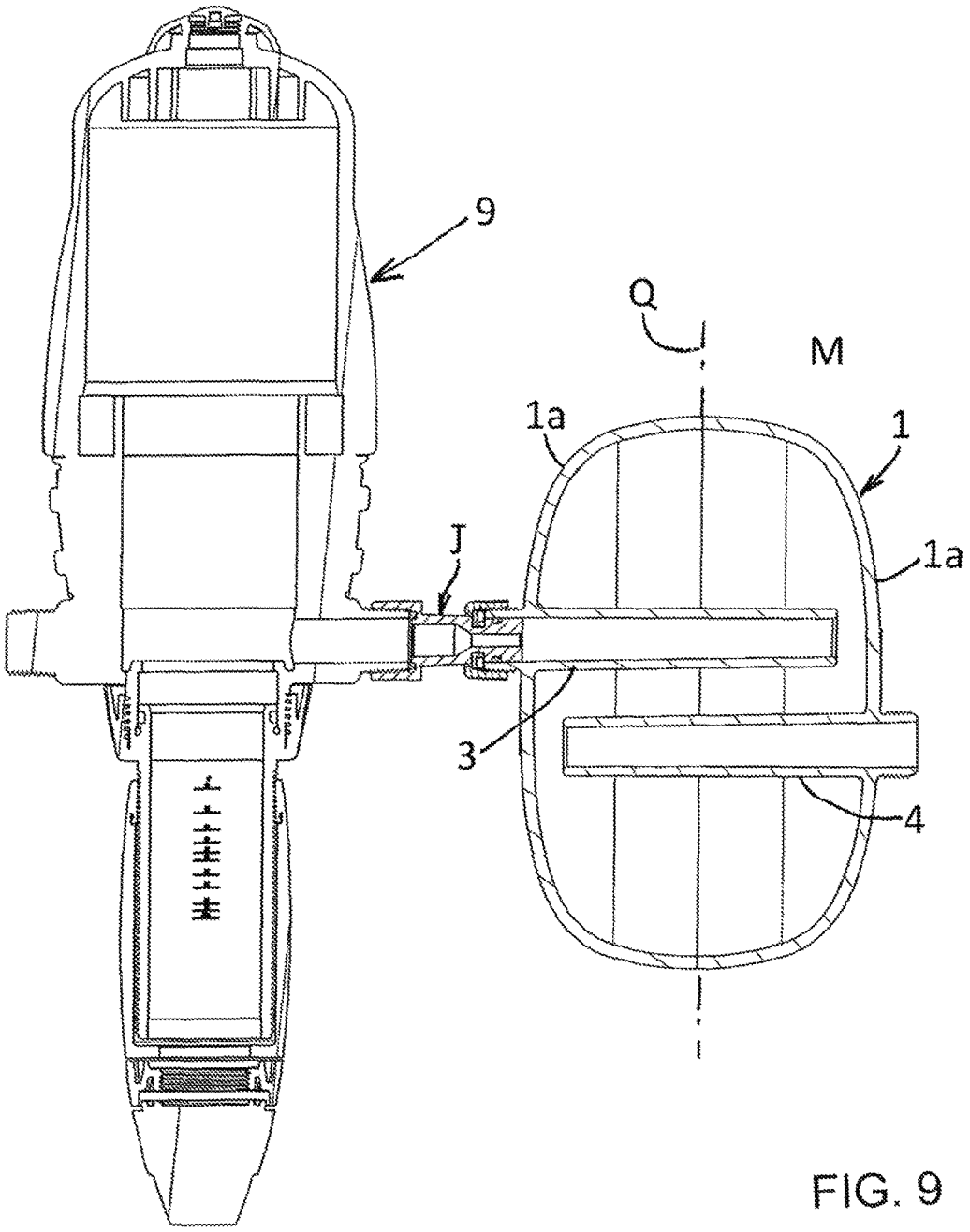
FIG. 9 is a vertical cross-section of the pump on which the mixer is secured.
Figure 10:
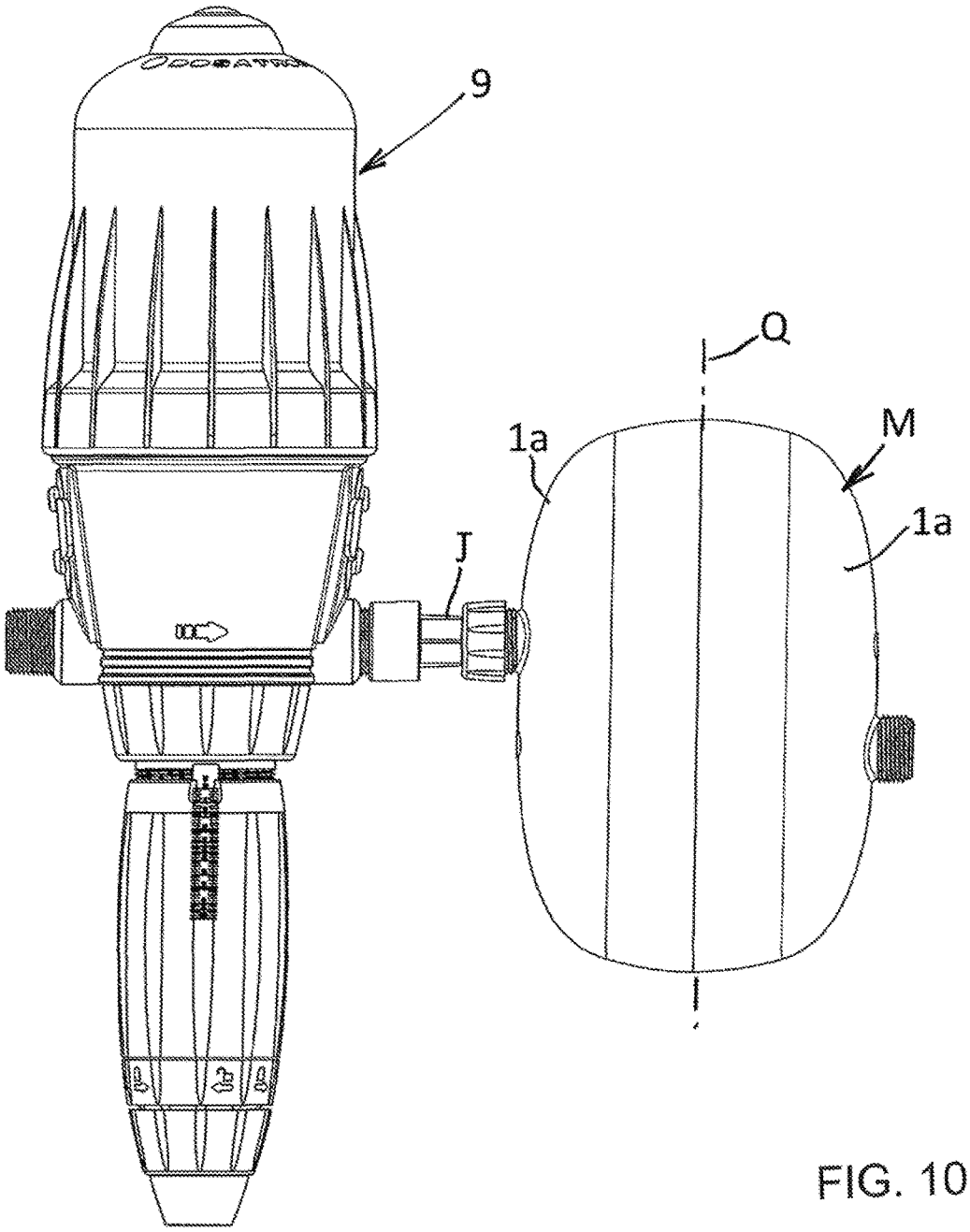
FIG. 10 is an elevated view of the pump and of the mixer in FIG. 9.

According to a variant, as illustrated in FIGS. 9 and 10, the mixer M can be produced with two identical half parts 1*a* which are turned and assembled head-to-tail, according to the vertical assembly plane Q. The mixer comprises an identical threaded ¾ input and output. The input is connected by a connection J to the output of the pump 9. According to the example in FIG. 9, the ducts 3 and 4 are horizontal and offset.

Whilst being simple and economical to produce, the mixer according to the invention makes it possible to obtain a homogenous mixture of at least two liquids, particularly with a relatively small dose of auxiliary liquid, which in particular is less than 5% of the main liquid.

The invention claimed is:

1. A static mixer for homogenizing a mixture of at least two liquids after injection of an auxiliary liquid into a main liquid, comprising:

a container (1) closed by walls comprising a top (1*a*), a bottom (1*b*) and lateral walls;

an input duct (3), starting from a first wall of said walls of the container, and extending as far as a vicinity of a second wall of said walls opposite to the first wall; and an output duct (4), substantially parallel to the input duct, which starts in a vicinity of the first wall and extends as far as the opposite second wall, each duct being provided with a device (3*a*, 4*a*) for connection to the exterior of the container through a corresponding one of said walls, wherein the container (1) has an oval horizontal cross-section, and the input duct (3) is situated in a vicinity of an end of an axis (8) of the cross-section, whereas the output duct (4) is situated substantially against the input duct (3), on a side of a center of the cross-section, wherein the mixer is produced with two identical half-parts, which are turned and assembled head-to-tail.

2. The mixer as claimed in claim 1, wherein the first wall is formed by the top (1*a*) of the container, and the opposite second wall is formed by the bottom (1*b*), the input duct (3) being vertical when the mixer is in a position of work, starting from the top and extending as far as a vicinity of the bottom, whereas the output duct (4) starts in a vicinity of the top and extends as far as the bottom.

3. The mixer as claimed in claim 2, wherein a lower part of the input duct (3) has a partially open transverse cross-section (3*b*), the open part of the cross-section being closed substantially by one of the lateral walls of the container.

4. The mixer as claimed in claim 1, wherein the input duct is horizontal, as is the output duct.

5. The mixer as claimed in claim 1, wherein the input duct (3) is arranged in a vicinity of one of the lateral walls of the container (1).

6. The mixer as claimed in claim 5, wherein the input duct (3) is arranged against the one of the lateral walls of the container (1).

7. The mixer as claimed in claim 1, wherein the output duct (4) is arranged in a vicinity of the input duct (3).

8. The mixer as claimed in claim 7, wherein the output duct (4) is arranged against the input duct.

9. The mixer as claimed in claim 1, wherein the plane of parallel axes of the input duct (3) and the output duct (4) contains the axis (8) of the horizontal cross-section of the mixer.

10. The mixer as claimed in claim 1, wherein the bottom (1*b*) and the top (1*a*) of the container are curved.

11. The mixer as claimed in claim 1, wherein the container has a thickness, according to a direction orthogonal to a plane of the axes of the input duct and of the output duct, a ratio of which to the width of the container is between 0.3 and 0.7.

12. The mixer as claimed in claim 1, wherein the oval horizontal cross-section is elliptical.

13. A dosing device (D) for introduction of an auxiliary liquid (L1) into a flow of main liquid (L) circulating in a main duct (C), comprising:

a dosing pump (9) with a differential piston with reciprocal motion in order to collect the auxiliary liquid from a container, the pump including a first input (11) for receipt of a flow of the main liquid which ensures that the pump is driven, a second input (12) for collection of the auxiliary liquid, and an output (14) for mixing of auxiliary liquid and the main liquid, wherein a mixer (M) is arranged at the output (14) of the pump, said mixer being configured for homogenizing a mixture of at least two liquids after injection of the auxiliary liquid into the main liquid, said mixer including:

a container (1) closed by walls, which include a top (1*a*), a bottom (1*b*), and lateral walls, an input duct (3), starting from a first wall of said walls, and extending as far as a vicinity of a second wall of said walls opposite to the first wall, and an output duct (4), substantially parallel to the input duct, which starts in a vicinity of the first wall and extends as far as the opposite second wall, each duct being provided with a device (3*a*, 4*a*) for connection to an exterior of the device through one of the walls of the container.

14. The dosing device as claimed in claim 13, further comprising:

a flow divider (V) installed inside the main duct (C), with the dosing pump (9) being connected in parallel to the flow divider, the first input (11) of the pump being connected by a first pipe (16) to the input of the flow divider, and the output (14) of the pump is connected by a second pipe (15) to a neck of the flow divider, wherein the mixer (M) is arranged on the second pipe (15) between the output of the pump and the connection to the neck of the flow divider.

15. The dosing device as claimed in claim 14, wherein the volume of the container (1) is three times a capacity of the dosing pump (9), or more.

16. The dosing device as claimed in claim 13, wherein the volume of the container (1) is three times a capacity of the dosing pump (9), or more.

* * * * *